United States Patent [19]

Pauley

[11] Patent Number: 4,604,943

[45] Date of Patent: Aug. 12, 1986

[54] IMPULSE TOOL HAVING SHUT OFF SYSTEM

[75] Inventor: Reginald W. Pauley, Belle Mead, N.J.

[73] Assignee: Ingersoll-Rand Company, Woodcliff Lake, N.J.

[21] Appl. No.: 697,953

[22] Filed: Feb. 4, 1985

[51] Int. Cl.[4] ..... F15B 15/00

[52] U.S. Cl. ..... 91/59

[58] Field of Search ..... 91/59; 173/12

[56] References Cited

U.S. PATENT DOCUMENTS 4,278,427 7/1981 Lingenhole et al. ..... 91/59 X

*Primary Examiner*—Gerald A. Michalsky

*Attorney, Agent, or Firm*—R. J. Falkowski; A. N. Trausch III

[57] ABSTRACT

An impulse tool has an air motor connected to rotate a housing that carries a spindle adapted to be connected to a tool. The housing and cavity provide a pulsating force for rotating the spindle and tool to a pre-selected torque limit. When the limit is reached a rod in the housing is moved rearwardly to contact an "L" shaped arm. The "L" shaped arm is moved to release a valve assembly that operates to close off the air supply to the air motor and thereby turn off the tool.

7 Claims, 4 Drawing Figures

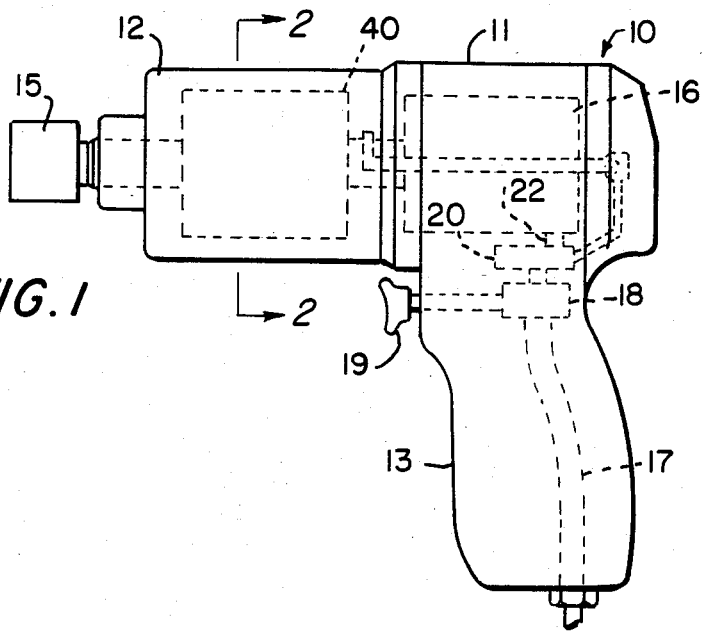
FIG. 1
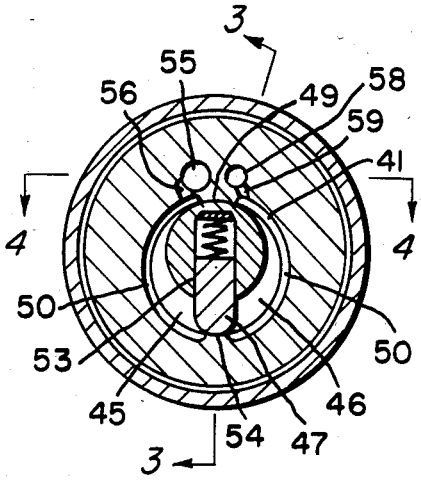
FIG. 2
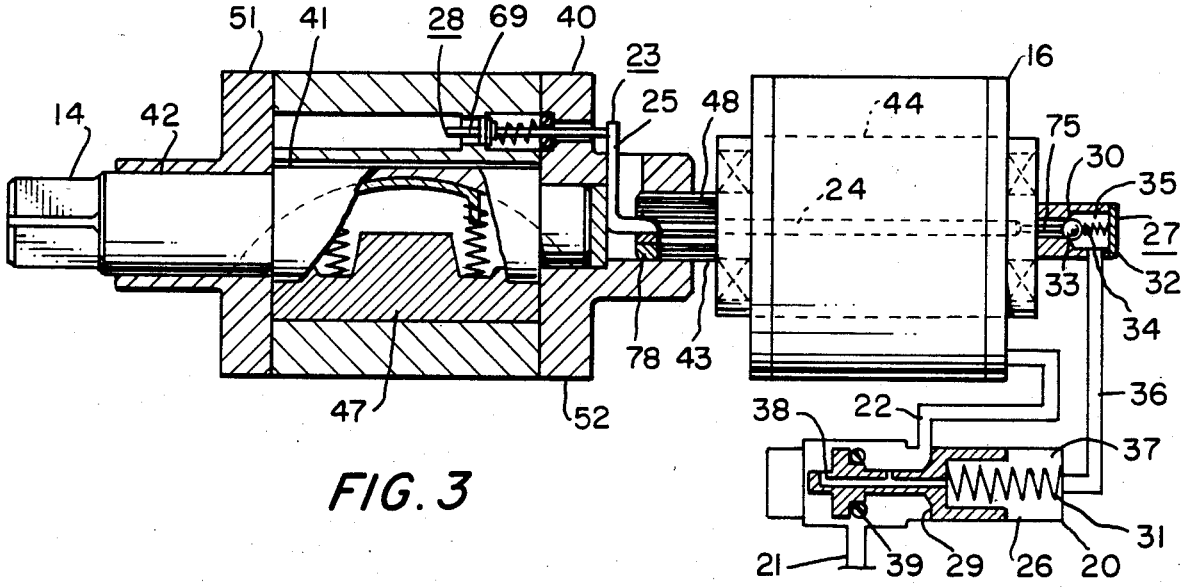
FIG. 3
FIG. 4
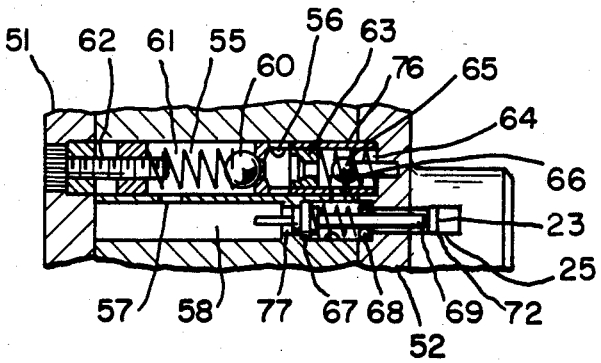

IMPULSE TOOL HAVING SHUT OFF SYSTEM

BACKGROUND OF INVENTION

This invention relates to impulse tools, particularly tools that shut off a driving motor at a predetermined torque output.

Presently tools with torque sensitive shut-off devices either have a piston mounted on the centerline of the impulse mechanism that moves a rod on the centerline of the motor to operate a shut-off device or have a piston mounted off the centerline that moves a complex and unreliable ring shaped air valve. Both of these configurations are undesirable because they make the tool relatively long and heavy, make the valving and porting complex, and provide inadequate performance.

With this invention an impulse tool has a shut-off system that enables a lighter, simpler and more reliable tool to be manufactured. This is accomplished in part because the shut-off piston is located in the housing of the impulse mechanism where space is available, thereby eliminating the need to increase size, and because the shut-off piston motion is transferred without requiring a complex rear cover or spindle or any mechanical pivots to reduce friction problems, and because fewer seals are required.

Other advantages of this invention will be apparent from the following detailed description.

DESCRIPTION OF DRAWINGS

FIG. 1 is a side elevational view of an impulse tool according to this invention.

FIG. 2 is a cross-sectional view taken along line 2—2 of FIG. 1.

FIG. 3 is a fragmentary cross-sectional side-view of the impulse unit and motor of the tool shown in FIG. 1 with the section of the impulse unit taken along line 3—3 of FIG. 2.

FIG. 4 is a partial cross-sectional view taken along line 4—4 of FIG. 2.

DESCRIPTION OF EMBODIMENT

Referring to FIG. 1, an impulse tool 10 has a casing 11 formed to include a barrel 12 and a handle 13. An air motor 16 of any known type is mounted within the casing and has a rotor 44 and a shaft 43 extending forwardly. A housing 40 is connected to shaft 43 to be rotated about its axis by the air motor. A rotatable spindle 14 is located within a cavity 41 within the housing that extends parallel to the axis. Spindle 14 projects from a forward end of barrel 12 and rigidly mounts a detachable tool holder or socket 15 adapted to rotatably drive a fastener or other workpiece.

Referring to FIGS. 1 and 3, a means for connecting air motor 16 to a pressurized air source (not shown) of any known type comprises an inlet passage 17, a conventional, normally closed, flow control valve 18 controlled by a trigger 19, a passage 21, a shut-off valve assembly 20, and a passage 22 connected to the air motor.

A means for pulsatingly rotating spindle 14 relative to housing 40 includes cavity 41 which is eccentrically positioned relative to and extends parallel to the axis of shaft 43 and contains a fluid such as oil. Spindle 14 is within and extends through cavity 41 and is rotatably journalled at one end of the housing in a bearing 42 to be rotatable about an axis of rotation. At the other end housing 40 is supported and driven by a spline connection 48 to shaft 43.

A shut-off means for controlling the pulsating rotation of the spindle to stop spindle rotation at pre-selected torque levels includes an "L" shaped arm 23 having a first section 24 extending along the axis of and through shaft 43 from a first end forward of the air motor to a second end 75 rearward of the air motor, and a second section 25 connected at a first end to the first end of the first section and extending perpendicular to the axis of shaft 43. An activating means for providing mechanical movement in response to the pre-selected torque level is connected to the spindle and housing. A rod 69 is located within the housing and displaced away from shaft 43 and parallel to it. A pressure means 28 for moving rod 69 in response to a pre-selected torque level is connected to the rod. A means 27 for disconnecting the air pressure source from the air motor is located adjacent to the second end of the first section of the arm.

Means 27 for disconnecting the air pressure source comprises a ball valve assembly 32 and shut-off valve assembly 20. Shut-off valve assembly 20 has a slidably mounted dump valve 26 biased by a coil spring 31 to the position shown which permits pressurized air to flow from passage 21 through passage 22 to motor 16.

Ball valve assembly 32 is connected to a chamber 37 in valve assembly 20 through an air passage 36 and has a ball 33 held in a ball seat 30 by a coil spring 34 in a ball chamber 35 to seal the passage of air. Passage 36 and chamber 35 are connected to passage 21 by a group of interconnecting holes 38 and chamber 37 in valve assembly 20. When ball 33 is moved off ball seat 30, pressurized air escapes rapidly from chamber 37 and the pressurized air in passage 21 drives dump valve 26 against spring 31 to a position where a seal 39 seats against a seal seat 29 to block air flow into passage 22 from passage 21 to shut off air motor 16.

Section 24 of arm 23 extends along the axis of and through air motor shaft 43 and section 25 extends perpendicular to the axis. Rod 69 and arm 23 are relatively positioned so that movement of the rod moves the arm by contacting a portion of section 25 and moves the arm rearwardly. Movement of the arm rearwardly causes the second end of section 24 to contact valve assembly 32 and to move ball 33 to operate valve assembly 32 and disconnect the air pressure source from the air motor by operating dump valve 26.

Referring to FIGS. 2 and 3, pressure means 28 for moving the rod in response to a pre-selected torque level includes a sealing means for dividing cavity 41 into a high pressure chamber 45 and a low pressure chamber 46 during a portion of the rotation of housing 40 relative to spindle 14, a blade 47 slidably mounted within a transverse slot 53 in spindle 14, and a pair of opposing lands 49 and 54 spaced by undercuts 50 on housing 40 in cavity 41. Spindle blade 47 and spindle 14 cooperate with lands 44 and 54 to dynamically seal cavity 41 during a portion of the rotation of housing 40 relative to spindle 14 to produce a pressure pulse in the fluid. This pulse causes blade 47 and spindle 14 to rotatably drive socket 15 with the energy stored in rotating housing 40 and rotor 44 of air motor 16. The seal formed generates a high pressure pulse once per revolution when the eccentric bore of cavity 41 and spindle 14 contact upper land 49 and blade 47 contacts lower land 54. At all other positions of revolution between housing 40 and spindle 14 a gap that allows fluid to be bypassed exists between spindle 14 and housing 40 and housing 40 can rotate freely relative to spindle 14.

Referring to FIGS. 2, 3 and 4, a shut-off system located in space available in housing 40 between a front cover 51 and a rear cover 52 has a connecting chamber 55 connected to high pressure chamber 45 through a passage 56, a passage 57 connecting chamber 55 to a chamber 58, and a passage 59 connecting chamber 58 to low pressure chamber 46.

A piston 63 is slidably located in a piston housing 76 located in chamber 55 and held in an open position by a coil spring 64 permitting fluid flow around a sealing ball 65 into a passage 66. As flow increases through piston 63 and when a high pressure develops in passage 56, a pressure differential is produced across piston 63 that overcomes spring 64 and moves piston 63 to a position against ball 65 to block fluid flow. This bypass control valve controls the cyclic rate of impulses as known in the art.

A ball 60 biased by a coil spring 61 in chamber 55 blocks the flow of fluid from passage 56 to passage 57 until a pressure level is reached based on the load set on spring 61 by an adjuster screw 62. When pressure in chamber 55 exceeds the set level, fluid flows through passage 57 and forces a piston 67 in chamber 58 that is biased by a coil spring 68 to move piston 67 out of a bore 77 in chamber 58.

Referring to FIGS. 3 and 4, rod 69 extends through rear cover 52. Section 25 of arm 23 is fixed relative to rod 69 by a slot 72. Rearward motion of rod 69 forces arm 23 to slide under the guidance of a bearing surface 78. End 75 of arm section 24 is in close proximity to ball 33. Rearward motion of rod 69 is transferred from the displaced radial location of rod 69 relative to the axis of shaft 43 to move ball 33 off its seat.

During the operation of impulse tool 10, depressing trigger 19 causes pressurized air to flow through inlet passage 17 and control valve 18 to passage 22 and to motor 16. The pressurized air supplied to air motor 16 rotatably drives the air motor and through spline connections 48 rotates housing 40. This rotation of housing 40 and its components causes spindle blade 47 to cooperae with lands 48 and 49 to seal cavity 41 into high pressure chamber 45 and low pressure chamber 46 to create a pressure pulse in chamber 45 and on spindle blade 47. The pressure pulse causes spindle 14 to develop torque and thereby rotatably drive socket 15. In this way, the fastener or other workpiece is driven by successive rotational pulses until the resisting torque increases the high pressure in chamber 45 sufficiently high to overcome the pre-set load of spring 61.

At this time, the fluid in chamber 55 moves ball 60 sufficiently to provide enough flow to move piston 67 out of the bore. The end of piston rod 69 moves arm 23 rearwardly to open the seal created by ball 33 whereupon ball chamber 35 and chamber 37 are exhausted to atmosphere. Exhausting chamber 37 moves trip valve 30 to a closed position stopping the flow of pressurized air from passage 21 to passage 22 to shut off air motor 16.

I claim:

1. A torque controlled air tool having an air motor connectable to an air pressure source, a rotatable spindle connected to the air motor, a means for rotating the spindle, and a shut-off means for controlling the rotating of the spindle to stop rotating of the spindle at a pre-selected torque level, said shut-off means comprising:

an activating means connected to the spindle for providing mechanical movement in response to the pre-selected torque level;

an arm having a first section extending along an axis and a second section extending away from said axis, said second section having a portion located adjacent the activating means and positioned so that movement by the activating means moves the arm; and a means connecting to the arm at its first section for disconnecting the air pressure source from the air motor upon movement of the arm.

2. An air tool according to claim 1 wherein said means for disconnecting comprises a valve assembly connected rearwardly of the air motor and positioned to be connected to and moved by rearward movement of the arm and connected to operate the disconnect the air pressure source from the air motor upon such movement of the valve assembly.

3. An air tool according to claim 1 wherein said activating means comprises a rod and a pressure means connected to the rod for moving the rod in response to the pre-selected torque level, and said arm is positioned so that movement of the rod moves the arm.

4. An air tool according to claim 3 wherein said means for disconnecting comprises a valve assembly connected rearwardly of the air motor and positioned to be connected to and moved by rearward movement of the arm and connected to operate to disconnect the air pressure source from the air motor upon such movement of the valve assembly.

5. A torque controlled air tool having an air motor with a shaft rotatable about an axis, a means for connecting the air motor to an air pressure source to rotate the air motor shaft about the axis, a housing located forward of the air motor connected to and rotatable with the shaft and having a cavity extending parallel to the axis, a rotatable spindle within the cavity, a means for rotating the spindle relative to the housing, and a shut-off means for controlling the rotating of the spindle to stop rotating of the spindle at a pre-selected torque level, said shut-off means comprising:

an activating means connected to the housing for providing mechanical movement in response to the pre-selected torque level;

an "L" shaped arm having a first section extending along and through the axis of the air motor shaft from a first end to a second end, and a second section connected to the first section at its first end and extending at an angle to said axis, ssaid second section having a portion located adjacent the activating means and positioned so that movement of the activating means moves the arm; and a means adjacent to the arm at the second end of its first section for disconnecting the air pressure source from the air motor upon movement of the arm.

6. An air tool according to claim 5 wherein said activating means comprises a rod within the housing displaced from the axis and extending substantially parallel to said axis and a pressure means connected to the rod for moving the rod in response to the pre-selected torque level, and said arm is positioned so that movement of the rod moves the arm.

7. A torque controlled air tool having an air motor with a shaft rotatable about an axis, a means for connecting the air motor to an air pressure source to rotate the air motor shaft about the axis, a housing located forward of the air motor connected to and rotatable with the shaft and having a cavity extending parallel to the axis, a rotatable spindle within the cavity, a means for pulsatingly rotating the spindle relative to the housing, and a shut-off means for controlling the rotating of the spindle to stop rotating of the spindle at a pre-selected torque level, said shut-off means comprising:

a rod within the housing extending from a first end to a second end and displaced from the axis and extending parallel to said axis;

a pressure means for moving the rod a selected distance rearwardly toward the air motor in response to the pre-selected torque level;

an "L" shaped arm having a first section extending along the axis of and through the air motor shaft from a first end to a second end rearward of the air motor and a second section connected to the first section at its first end and extending perpendicular to the first section, said second section having a portion located adjacent the first end of the rod and positioned so that moving the rod rearwardly contacts and moves the arm rearwardly; and a valve assembly connected rearwardly of the air motor and positioned to be contacted by the first section of the arm at its second end and moved by rearward movement of the arm, said valve assembly connected and adapted to operate to disconnect the air pressure source from the air motor upon being moved by the arm.

* * * * *